US005126914A

United States Patent [19]

Tada et al.

[11] Patent Number: 5,126,914

[45] Date of Patent: Jun. 30, 1992

[54] CURRENT INVERTER FOR AN INCANDESCENT LAMP IN A CAR RADIO

[75] Inventors: Shigeo Tada; Yukihiro Moriyama, both of Kawagoe, Japan

[73] Assignee: Pioneer Electronic Corporation, Tokyo, Japan

[21] Appl. No.: 492,170

[22] Filed: Mar. 13, 1990

[30] Foreign Application Priority Data

Aug. 30, 1989 [JP] Japan ..... 1-223616

[51] Int. Cl.[5] ..... H05B 39/06

[52] U.S. Cl. ..... 361/245; 315/77; 315/209 R; 455/159.2; 455/345; 307/10.8

[58] Field of Search ..... 307/9.1, 10.1, 10.8, 307/31, 154–157; 315/76, 77, 208, 209 R, 219, DIG. 7; 361/245, 246; 455/159, 343, 345; 362/86; 331/110; 363/16, 63, 98, 132

[56] References Cited

U.S. PATENT DOCUMENTS 3,849,607 11/1974 Carbrey ..... 361/245 X
4,292,467 9/1981 Odlen et al. ..... 455/159 X
4,400,651 8/1983 Nelle ..... 315/205

*Primary Examiner*—A. D. Pellinen
*Assistant Examiner*—David Osborn
*Attorney, Agent, or Firm*—Sughrue, Mion, Zinn, Macpeak & Seas

[57] ABSTRACT

A lamp power control circuit for electric equipment which has a power supply, supplies power to incandescent lamps fitted to operating parts of electric equipment and is provided with a current-direction inverter unit. This current-direction inverter unit inverts the direction of the electric current flowing through an incandescent lamp in response to a signal generated in response to manual operation of the operating parts. Consequently the effect of electromigration on filaments of incandescent lamps is decreased and occurrence of the notching is reduced, thus extending the life of lamps.

6 Claims, 6 Drawing Sheets

CURRENT INVERTER FOR AN INCANDESCENT LAMP IN A CAR RADIO

BACKGROUND OF THE INVENTION

This invention relates to a power circuit for lamps and. more particularly, to power control circuit for incandescent illumination lamps fitted to an operating panel of an audio system mounted in a car (hereinafter called a car stereo).

Various operating push buttons are provided on a operating panel for the car stereo. These push buttons are lit from their backside respectively with a lamp, so that a driver can easily operate the car stereo. By such illumination the stamped-out characters on the buttons, the indicators, and the circumference of buttons are lit and the function and position of each button can be distinguished. Incandescent lamps have been used for this illumination.

There are two lighting systems of incandescent lamps, that is, a AC lighting system using AC power and a DC lighting system using DC power.

As a conventional power circuit for incandescent lamps used for a car-stereo set, there has been used a DC lighting system which supplies DC voltage to incandescent lamps by direct connection to a battery mounted on a car.

However, the power circuit of the DC lighting system for incandescent lamps is complex as compared with that of the AC lighting system and also has such a problem that life of incandescent lamps is short.

For example, a conventional DC power circuit for incandescent lamps causes a symptom called notching in which with the passage of time the diameter of lamp filaments become irregular. That makes, with the passage of time, irregular the diameter of lamp filaments which are uniform before use, and thus the filament surfaces becomes uneven. Further progress of this symptom burns a thinned part to break it. Hence the notching greatly affects the life of lamps. From the past study it has been proved that the notching is caused by partial crystal growth in the filaments as a result of movement of metal ions in the filament metal along an electric field which is generated in the filaments because the incandescent lamp is lit with the direct current. Such behavior of metal ions is called an electromigration effect.

The purpose of this invention is to provide a lamp power control circuit capable of extending the life of incandescent lamps by reducing the notching of lamp filaments even when a DC lighting system is used for the lamp power circuits.

SUMMARY OF THE INVENTION

In order to solve the above-mentioned purpose of resolving the notching problem, this invention provides the lamp power control circuit which is connected to a power source and supplies power to incandescent lamps installed in a operating section of electric equipment with a current-direction inverter unit which receives signals generated in the operating section at the time of operation of the operating section as inversion control signals, and inverts the direction of electric current passing through the incandescent lamps in response to the inversion control signals.

In this invention, the current-direction inverter section inverts the direction of current in lamps in every timing of signal generation which accompanies operation of the operating section. Therefore, the direction of the current flowing through lamps is alternated, thus enabling substantially AC lighting. As a result, effects of the electromigration can be reduced and occurence of the notching can be suppressed.

As described above, this invention assures effective extension of the lamp life by means of simple circuit configuration.

DESCRIPTION OF THE PREFERRED EMBODIMENTS

Figure 1:
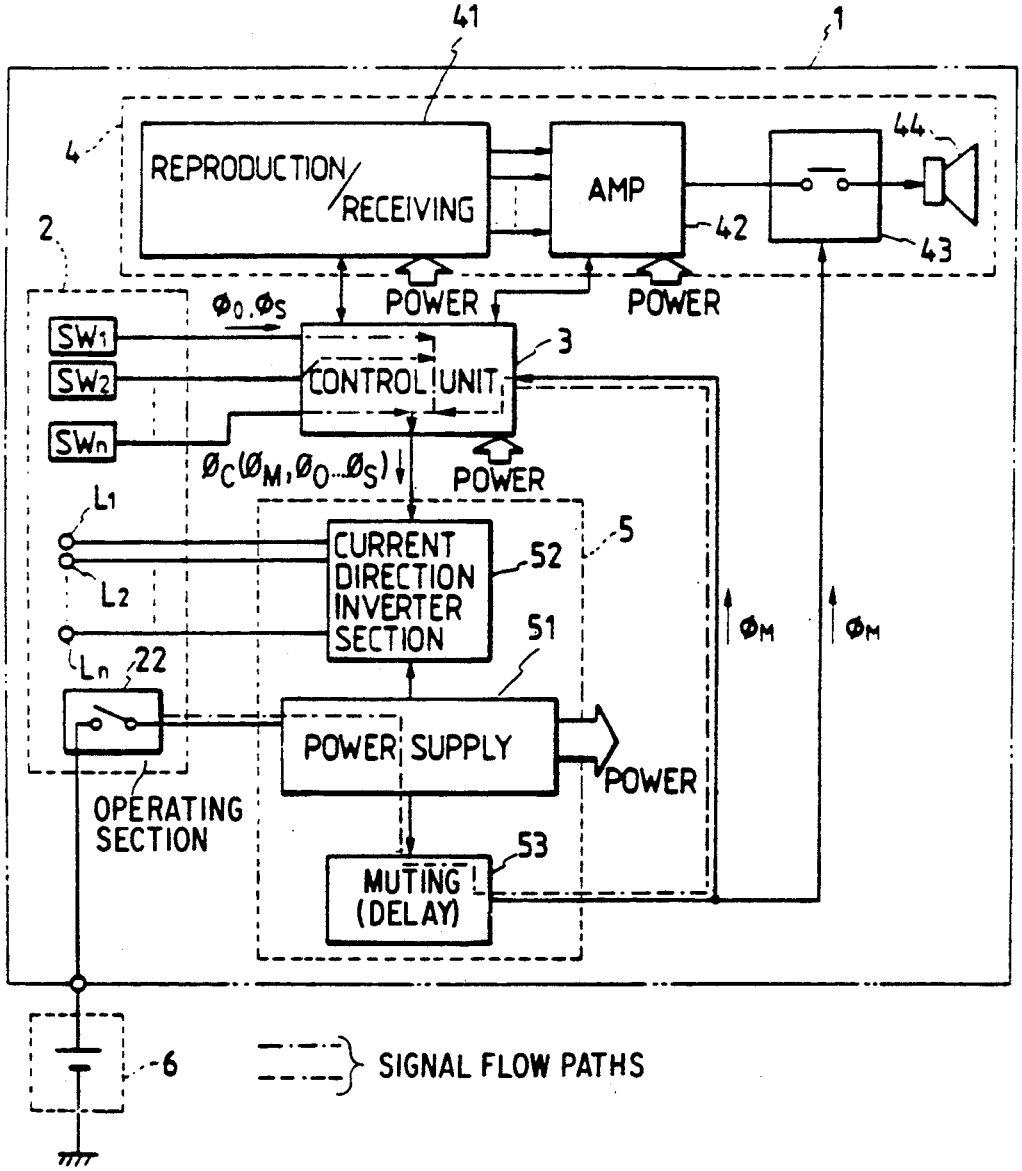
FIG. 1 is a schematic block diagram of a car stereo to which an exemplary embodiment of this invention is applied.

FIG. 1 shows a block diagram of an embodiment of this invention applied to a car stereo 1, which is provided with a operating section 2 to carry out such operations as key entry, a control unit 3 to control the whole system, a reproducing section 4 to reproduce signals sent from a CD player, a cassette deck, etc., and a power circuit 5 to supply power to each of the above sections.

The operating section is provided with an operating panel, and a power switch, 22 a plurality of operating switches $SW_1$, $SW_2$—$SW_n$ and a plurality of lamps $L_1$, $L_2$—$L_n$ for indication or switch illumination.

Figure 2:
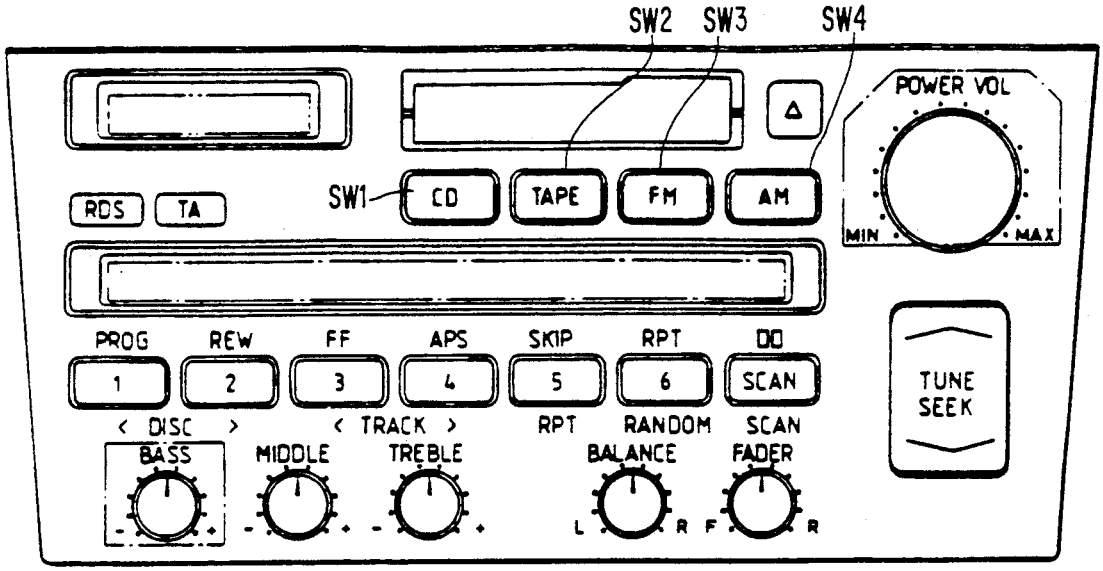
FIG. 2 is a front view of an embodiment of a car-stereo operating panel.

FIG. 2 shows an embodiment of the operating panel of a car stereo using a lamp power control circuit.

Figure 3:
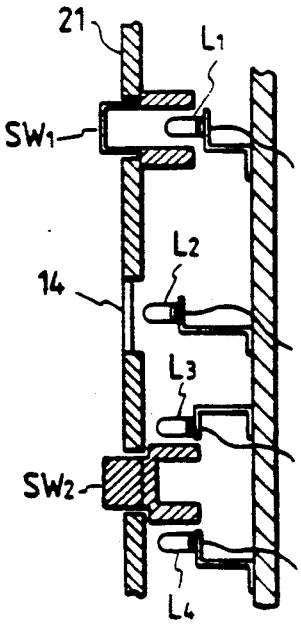
FIG. 3 is a sectional view of the operating panel of FIG. 2.

Furthermore, FIG. 3 is a sectional view of the operating panel shown in FIG. 2. The operating panel 21 is fitted with a back-lighted switch SW1, an indicator 14, and periphery-lighted switch $SW_2$. The key top of the backlighted switch $SW_1$ is transparent and is illuminated by lamp $L_1$. An indicator 14 is lit with a lamp $L_2$ mounted at the back of a small transparent window. The periphery-lighted switch $SW_2$ is illuminated by light which appears to come up from the panel surface owing to leaking light of lamps $L_3$ and $L_4$ which have been mounted at the back of the operating panel 21.

The control unit is provided with a CPU (Central Processing Unit) and memory, which are not shown in the figures, and controls every part of the car stereo 1 as a whole by a program stored in a ROM (Read Only Memory).

The reproducing section 4 is provided with a signal reproducing/receiving unit 41, an amplifier unit 42, a relay unit 43, and a speaker 44. The signal reproducing-/receiving unit 1 is an input source including reproducing equipment such as a CD player and a cassette deck, and receivers such as a FM/AM tuner. The reproducing section 4 is connected to a control unit 3, which selects a music source in the reproducing section 4 and controls the frequency response and gain of the amplifier.

The power circuit 5 is provided with a power supply unit 51, and a current-direction inverter unit 52 and a muting unit 53. The power supply unit 51 is connected to and receives power from a car-mounted battery power supply 6 via a power switch 22. The muting circuit 53 is connected to the relay unit 4 of the signal reproducing section 43.

Figure 4:
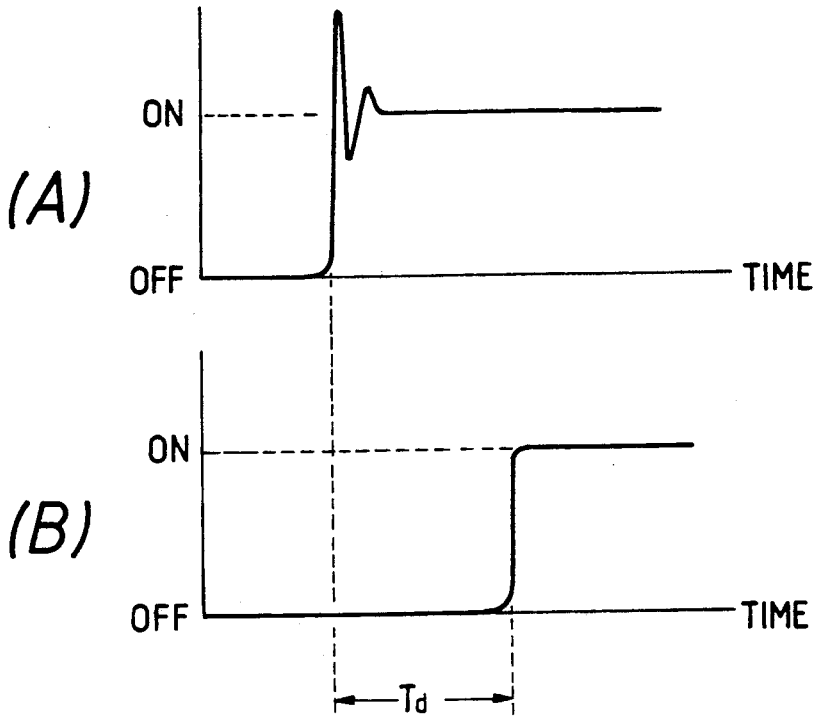
FIG. 4 is a graphic illustration of operations of a muting section.

The power supply unit 51 supplies power to the control section 3 and the signal reproducing section 4. The power supply unit 51 is further connected to the current-direction inverter unit 52, through which the power current is supplied to lamps $L_1$ and $L_2$. The muting unit 53, a kind of delay circuit mainly composed of resistors and capacitors, is connected to the power supply unit 51. Therefore, as shown in FIG. 4A, the moment that the power switch 22 is turned ON, a shock pulse is generated in the power circuit, the power voltage falls to a constant voltage after a constant delay time Td by the delay function of the muting unit 53 (FIG. 4B). At this time the voltage is supplied to the relay unit 43 of the signal reproducing section 4 as a mute signal $\Phi m$. The relay unit 43 is normally kept in OFF condition, and turned ON when the relay unit 43 receives a mute signal $\Phi m$. As a result, the amplifier 42 and speaker 44 are connected, thus preventing direct input of the shock pulse, generated the moment when the power is turned ON, into the speaker 44. When this transitional shock pulse is directly input into the speaker 44, it becomes an overload on a voice coil or vibrating parts of the speaker, and damages the speaker in the worse case. The muting and relay units perform their function as a speaker protection circuit.

The muting unit 53 is connected to the control unit 3, which is also connected to the current-direction inverter unit 52. Therefore, the mute signal $\phi m$ is also supplied to the control unit 3. At this time, the control unit 3 supplies the mute signal $\phi m$ to the current-direction inverter unit 52 as an inverter control signal $\phi c$. When the current-direction inverter unit 52 receives the inverter control signal, $\phi c$ it inverts the direction of current in reverse direction to that of current before the receipt of the signal, and supplies the current to lamps $L_1$ and $L_2$, thus serving as a lamp power control circuit.

Figure 5:
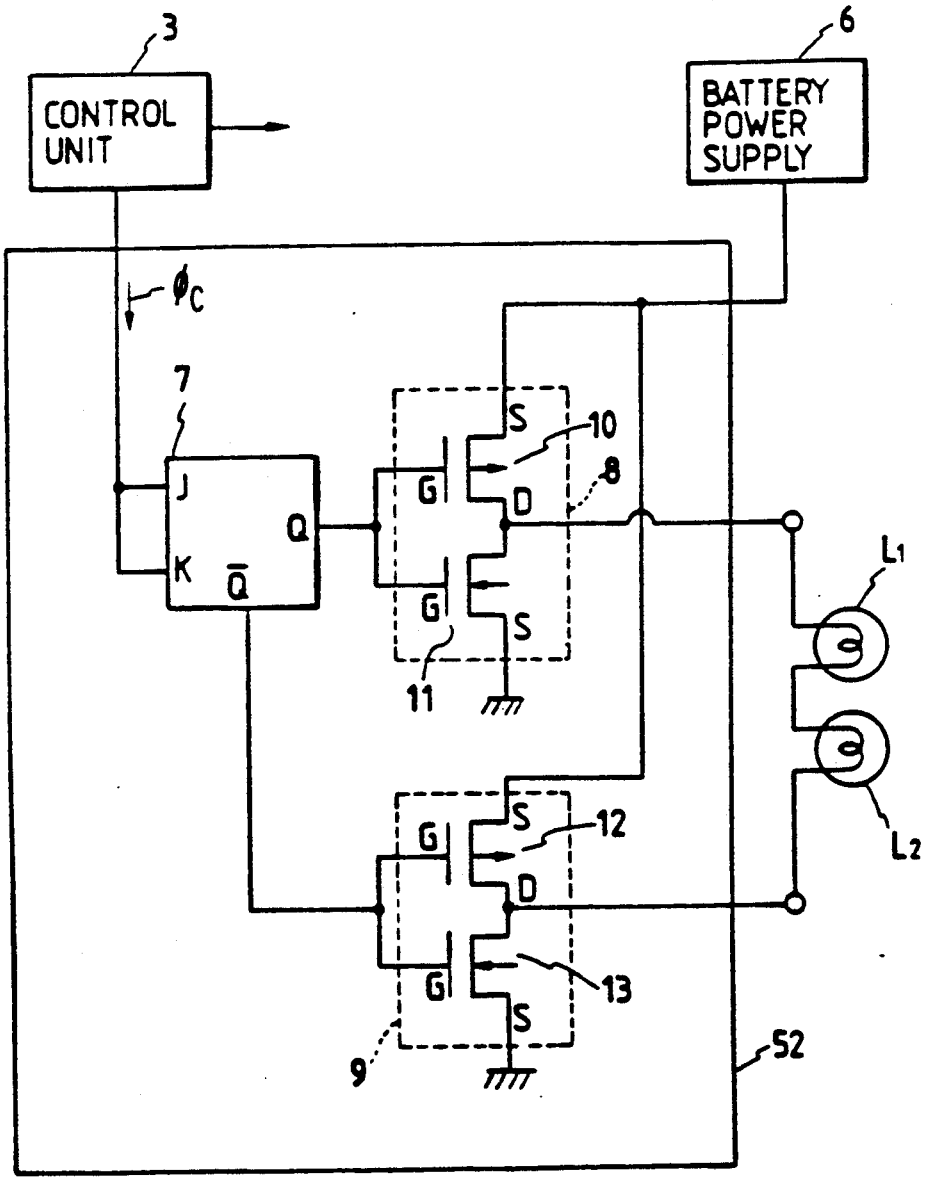
FIG. 5 is a circuit diagram of an embodiment of the current-direction converter section of this invention.

As shown in FIG. 5, the current-direction inverter unit 52 is provided with a JK flip-flop circuit 7 which outputs a inversion command signal, a first switch 8 and a second switch 9.

The JK flip-flop circuit 7 has a bistable circuit which keeps a stable condition unchanged until an input signal for transition of the circuit to another stable condition. The JK flip-flop circuit is provided with two input terminals J and K, two output terminals Q and $\overline{Q}$, and clock terminals (not shown in the drawings). Of these terminals the input terminals J and K are connected to the control unit 3.

The first switch 8 is a CMOS (Complementary Metal-Oxide-Semiconductor) transistor switch composed of a PMOS transistor 10 and a NMOS 11, and the second switch 9 is a CMOS transistor switch composed of a PMOS transistor 12 and a NMOS transistor 13, where G is a gate terminal, D a drain terminal and S a source terminal.

In the first switch 8 both gates of the PMOS transistor 10 and the NMOS transistor 11 are connected to the output terminal Q of the JK flip-flop circuit 7. The source of the PMOS transistor 10 is connected to the battery power supply 6, and the source of the NMOS transistor 11 is grounded. Both drains of the PMOS transistor 10 and NMOS transistor 11 are connected to a terminal of the lamp $L_1$.

In the second switch 9, both gates of the PMOS transistor 12 and the NMOS transistor 13 are connected to the output terminal Q of the JK flip-flop circuit 7. Furthermore, the source of the PMOS transistor 12 is connected to the battery power supply 6, and the source of the NMOS transistor 13 is grounded. Both drains of the PMOS 12 and the NMOS transistor 13 are connected to a terminal of the lamp $L_2$.

The lamps $L_1$ and $L_2$ are interconnected. Therefore, the lamps $L_1$ and $L_2$ are arranged in serial connection between the drains of the MOS transistors 10 and 11 and drains of the MOS transistors 12 and 13.

The JK flip-flop circuit 7 uses a mute signal $\phi m$ given by the muting unit 53 via the control unit 3 as inverter control signal $\phi c$, that is, as the control input of the circuit.

The operation of the circuit is described hereunder. As the initial condition, kit should be assumed that the terminal Q of the JK flip-flop circuit 7 outputs "H", and the terminal Q outputs "L".

In the above condition, the output "H" at the terminal Q is input to the gate of transistor 10 of the first switch 8 and the transistor 10 is turned OFF. On the other hand, the transistor 11 of the first switch 8 is turned ON because "H" is input to the gate of the transistor 11. In the same way, input "L" of the terminal $\overline{Q}$ is input to the gate of transistor 12 of the 2nd switch 9, and the transistor 12 is turned ON. At the same time, the transistor 13 is turned OFF because "L" is input to its gate.

Figure 6:
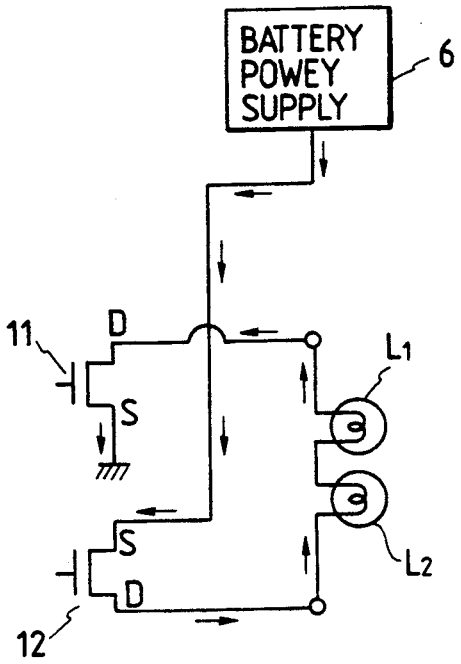
FIGS. 6–7 are circuit diagrams illustrating the operation of the circuit shown in FIG. 5.

As a result, the current supplied from the battery power supply 6 flows, as indicated by arrows in FIG. 6, along the route of the source and drain of the transistor 12, lamp $L_2$, lamp $L_1$, the drain and source of the transistor 11, and the ground.

When, after the above operation, the power switch 22 is turned OFF and again turned ON, a mute signal $\phi m$ is sent out to the control unit 3 and to the signal reproducing section 4 and causing switching control signal $\phi c$ to be applied to the JK flip-flop circuit 7. As a result, the outputs at terminals Q and $\overline{Q}$ of the JK flip-flop circuit 7 are inverted. Consequently "L" is output from the terminal Q and input to the gate of transistor 10 of the first switch 8, turning ON the transistor 10. The transistor 11 is turned OFF because "L" is input to its gate. In the same way, "H" is output from the terminal $\overline{Q}$ and input to the gate of transistor 12 of the second switch 9, turning OFF the transistor 12. The transistor 13 is turned ON because "H" is input to its gate.

Figure 7:
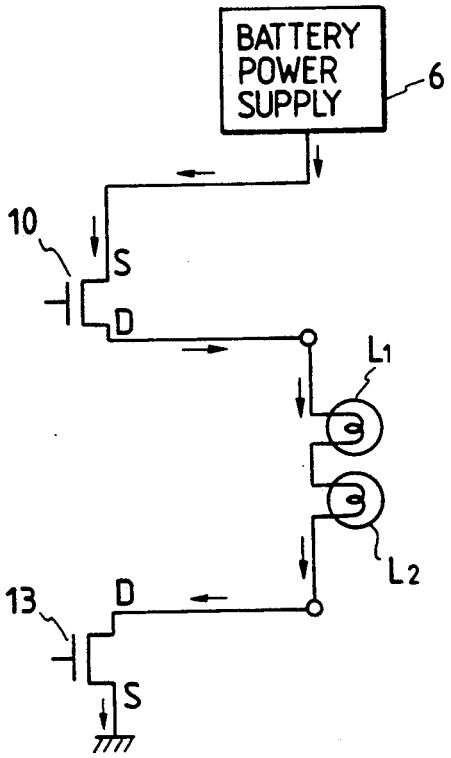
Figure 9:
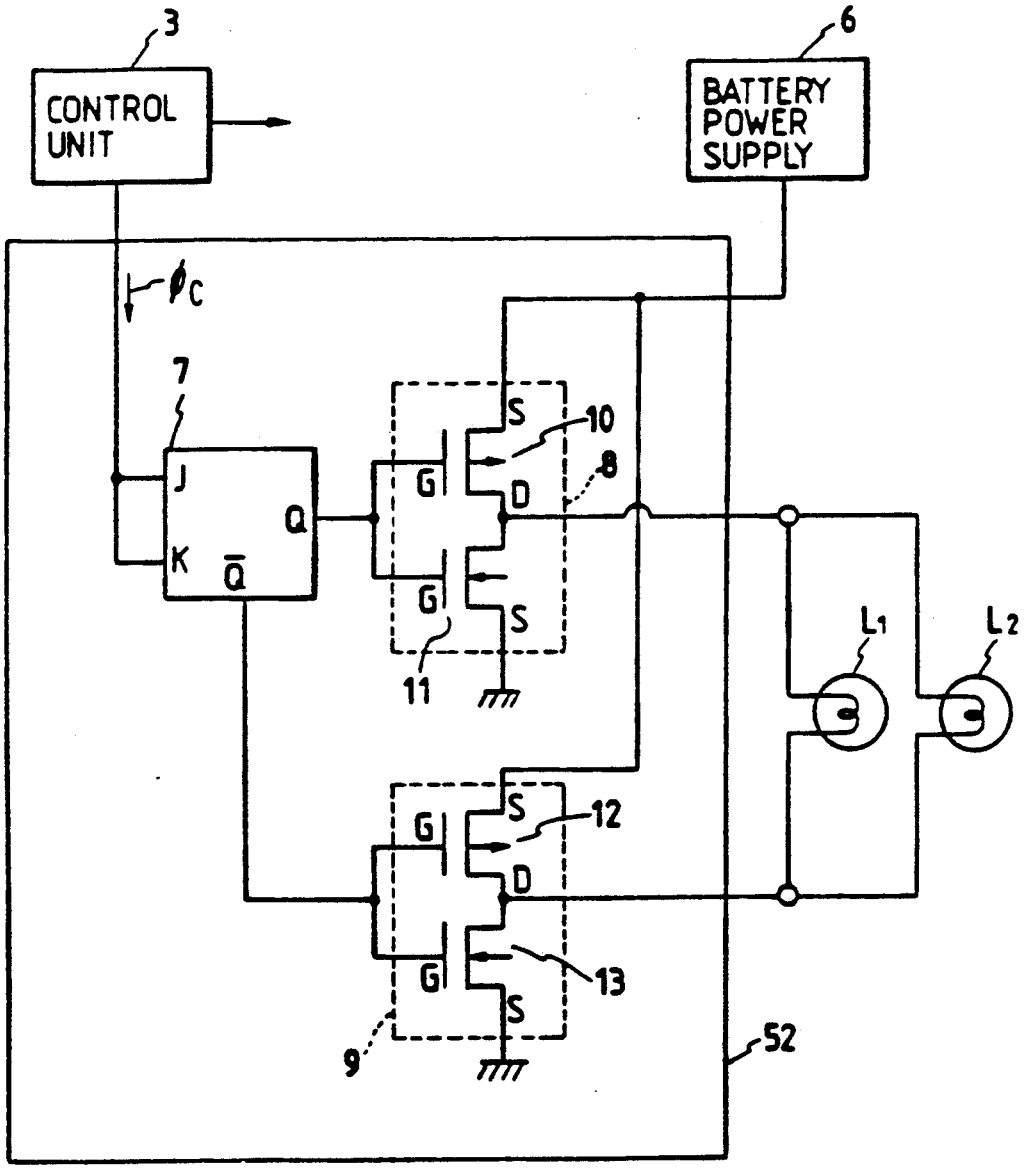
FIG. 9 is a circuit diagram of another embodiment of the current-direction inverter section of this invention.

As a result, the current supplied from the battery power supply 6 flows, as indicated by arrows in FIG. 7, along the route of the source of the transistor 13, and the ground.

Figure 8:
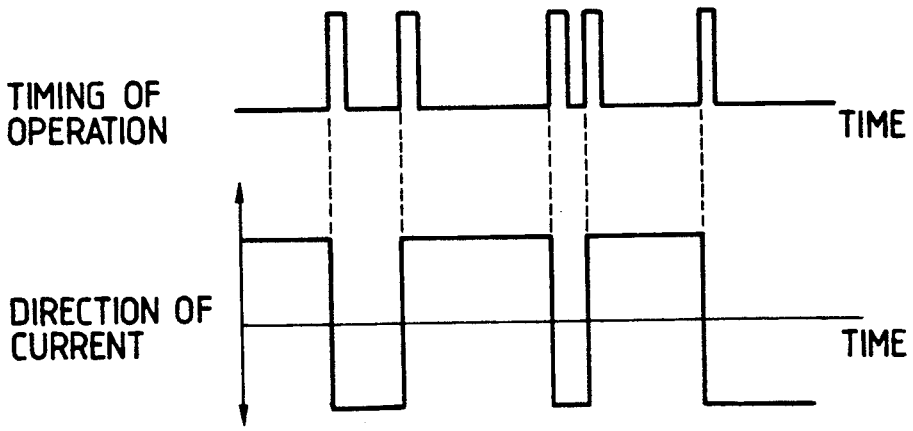
FIG. 8 is a timing chart for the embodiment shown in FIG. 5.

In the above-mentioned exemplary embodiment, the direct of the current flowing through the lamps are inverted every time the power switch is operated, as shown in FIG. 8, and substantially comes to the same condition as AC lighting. Therefore, the electromigration becomes difficult to be caused and the notching is suppressed, thus the life of lamp filaments are extended.

The above-mentioned embodiment uses a mute signal $\phi M$ as a timing signal for current direction inversion.

However, as shown in FIG. 1, an operation command signal $\phi s$ supplied from the operating unit to the control unit by switch operations may be used. In this case it is preferable to use a signal of less noise generation.

Furthermore, although in exemplary embodiment shown in FIG. 5, the lamps are serially connected, this invention may be also applied to the case having parallel connection of the lamps. In place of the JK flip-flop circuit, any other flip-flop circuit which has the same function may be used.

As the inverter control signal $\phi c$ for operation of the circuit, the source selector signal $\phi c$ which is used for selecting reproducing signal from input source equipment such as a CD player or a tuner by means of a selector or the like can be adopted as shown in FIG. 1.

Although a specific embodiment of car stereo sets has been described hereinabove, this invention can be applied to other electric household appliances.

As this invention may be embodies in many different forms without departing from the spirit and essential characteristics thereof, the embodiment described hereinabove is therefore illustrative and not restrictive, since the scope of the invention is defined by the appended claims rather than any of the details of description, and all changes and modifications that fall within limits and bounds of the claims, or equivalence of such limits and bounds are therefore intended to be embraced by the claims.

What is claimed is:

1. A lamp power control circuit for electric equipment for supplying power to incandescent lamps which are connected to a power supply and which are fitted to a plurality of operating parts of said electric equipment, comprising a current-direction inverter section for inverting a direction of current in said incandescent lamps in response to a inversion control signal, said inversion control signal being generated once in response to each manual operation of a predetermined one of said operating parts located in an operating section of said electric equipment.

2. A lamp power control circuit as defined in claim 1, wherein said current-direction inverter section comprises: a flip-flop circuit; and two semiconductor switches, each of said switches having a complementary metal-oxide semiconductor (CMOS) transistor; wherein a gate of one of said two semiconductor switches is connected to a first output terminal of said flip-flop circuit; wherein a gate of the other one of said two semiconductor switches is connected to a second output terminal of said flip-flop circuit; wherein said power supply is connected to two sources of said two semiconductor switches; and wherein said incandescent lamps are connected between drains of said two semiconductors switches.

3. A lamp power control circuit as defined in claim 1, wherein said electric equipment is a car-mounted stereo set which selectively amplifies reproduced signals of a plurality of input source equipment.

4. A lamp power control circuit as defined in claim 3, wherein a power circuit of said car stereo set comprises a muting circuit which makes driveable a speaker after the passage of a predetermined time from energization of the circuit by turning ON a power switch and a muting signal is used as said inversion control signal.

5. A lamp power control circuit as defined in claim 3, wherein said car stereo set further comprises a control unit which performs control in response to an operation command signal delivered from said operating section of said car stereo set and uses said operation command signal as an inversion control signal.

6. A lamp power control circuit as defined in claim 5, wherein said operation command signal is a signal used for source selection for selecting said reproduced signal of input source equipment.

* * * * *